United States Patent [19]

Weiser

[11] 4,434,511

[45] Mar. 6, 1984

[54] HOSPITAL GOWN

[75] Inventor: Georgiann Weiser, Dallas, Oreg.

[73] Assignee: Weiser Designs, Ltd., Amity, Oreg.

[21] Appl. No.: 460,451

[22] Filed: Jan. 24, 1983

[51] Int. Cl.[3] ..... A41B 9/00

[52] U.S. Cl. ..... 2/114

[58] Field of Search ..... 2/114, DIG. 7, 69, 74

[56] References Cited

U.S. PATENT DOCUMENTS 2,768,383 10/1956 De Will ..... 2/114

3,748,659 7/1973 Meyers ..... 2/114

*Primary Examiner*—Doris L. Troutman

*Attorney, Agent, or Firm*—Robert L. Harrington

[57] ABSTRACT

A gown for use by hospital patients and the like wherein the beginning and ending end edges are located at the front and side of the patient. A separable shoulder portion is provided for that side of the gown by upper edges adjacent both end edges overlapping the upper edge of the back panel of the gown which are interconnected by releasable fastening means, e.g. material fasteners. This gown enables dressing of a patient with one arm encumbered by intravenous feeding in that the shoulder portion is separable, and it further provides for chest and stomach examination without removal of the gown. It further provides for coverage of the patients backside when venturing from the bed, all with a design that is universal to all patients and inexpensive to produce.

6 Claims, 3 Drawing Figures

HOSPITAL GOWN

BACKGROUND OF INVENTION

This invention relates to gowns such as used by hospital patients.

A standard gown used by patients in hospitals and the like is comprised of a squarish piece of material with two arm holes located in the upper center portion of the square. The patient's arms are thrust through the arm holes and the patient is covered in the front from neck to knees. The material is wrapped around the sides of the patient and tied together at the patient's back.

The standard hospital gown has advantages over conventional nightwear. The simple hospital gown is inexpensive as compared to conventional nightwear and one size fits all types and sizes of patients. The gown is also easy to put on the patient while that patient is lying in bed.

There are disadvantages however. The gown has to be removed before the patient can be examined in the chest or stomach area. Also, if the patient is being fed intravenously there is a problem getting the patient's arms through the arm holes. From the point of view of the typically, somewhat modest patient, the exposure of the patient's backside every time he ventures from bed is embarrassing.

SUMMARY OF INVENTION

The preferred embodiment of the present invention is believed to retain the benefits of the above described, typical hospital gown while eliminating the disadvantages. Briefly, this preferred embodiment comprises a gown that is designed to be wrapped around the patient but starting at the patient's side, or more correctly, at the front of the patient's side. The material is wrapped across the front of the patient and an arm hole is provided for the arm at the opposite side of the patient. The material continues across the back of the patient and around the first side. A relief slit is provided (rather than an arm hole) to enable the material to fit under the other arm of the patient and the end edges are overlapped and fastened together.

Of particular importance to this preferred embodiment is the overlapping of a portion of the upper edge of the back panel of the gown with the upper edge of the front panel, at the patient's shoulder. This overlapping occurs when the two end edges overlap so that both ends of the gown are overlapped by the back panel portion. This overlapping of the back panel provides a separable shoulder portion for the other arm of the patient. It will be appreciated that three areas of overlap are provided, i.e., the end edges overlap each other along the front side of the patient, and the upper edge of each overlaps the back of the gown at the shoulder of the patient. Fastening means are provided, e.g., interlocking material fasteners such as the material fasteners sold under the "Velcro" Trademark, of Velcro USA, Inc., at each of the overlapping sections.

It will be understood that the gown of this invention is both inexpensive and has the same advantage of "one size fits all" that is touted for the typical hospital gown. The present preferred embodiment of the invention has the additional advantage of allowing for either or both end edges to be detached from the back panel portion of the gown. By detaching the first end edge only from both the back panel and the other end edge, the front of the patient can be exposed from examination without removing the gown. By detaching both end edges from each other and from the back panel, the gown can be easily slipped on and off the patient. Also, and of major importance to the modest patient, the gown does not expose his backside when venturing from the bed.

DETAILED DESCRIPTION

Having thus briefly described the preferred embodiment of the invention, a more complete understanding of the invention will be derived by reference to the following detailed description including drawings wherein.

Figure 1:
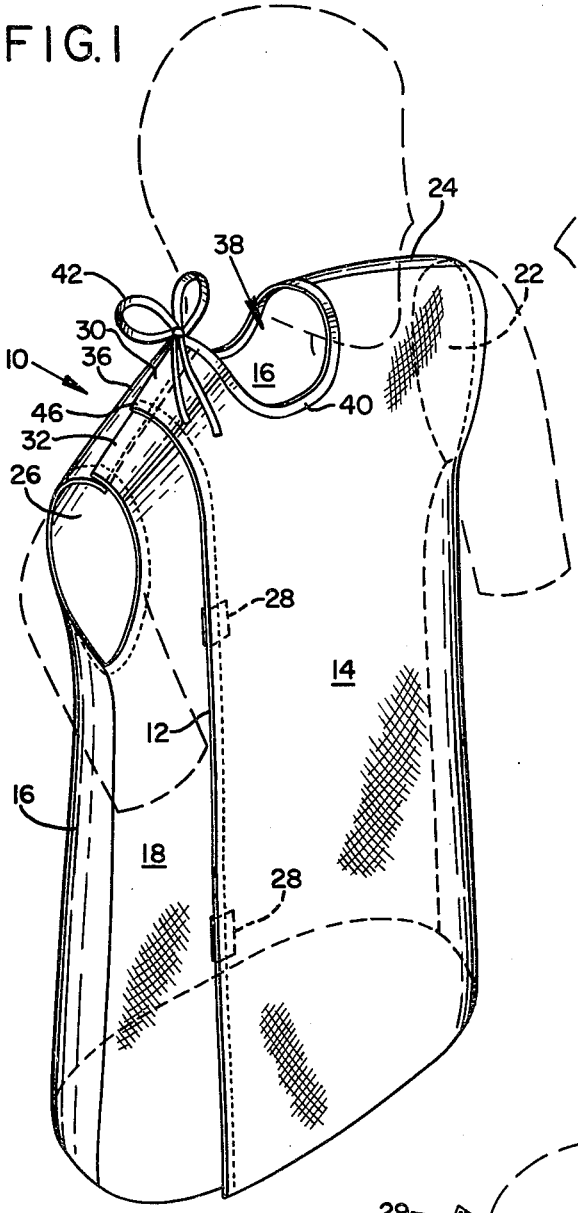
FIG. 1 is a perspective view of a gown of the present invention with phantom lines indicating a patient wearing the gown.

Referring to the drawings, a hospital gown 10 is designed, when worn by a hospital patient, to be wrapped around the patient, with the starting end edge 12 positioned at one side of the patient. A first front panel 14 extends from edge 12 across the front and to the other side of the patient to form a major portion of the front of the gown. A back panel 16 extends from said other side of the patient, where it interconnects with the first front panel 14, across the back of the patient to the first side. A second front panel 18 is interconnected with the back panel 16 at said first side and extends to the starting end edge and forms the gown's ending end edge 20.

Located appropriately in the upper area of the interconnection between the first front panel 14 and the back panel 16 is an arm hole 22. This arm hole 22 is formed by providing a relief in the material at the interconnected area and overlapping a portion of the upper edges of the front and back panels. This overlapping portion is fastened together as by sewing and forms a shoulder portion 24. The other arm of the patient is accomodated by a similar relief 26, but as will be explained, the upper edge portions forming the second shoulder portion are separable to allow the gown to be slipped under the arm of the patient as can be seen in FIG. 3.

Figure 3:
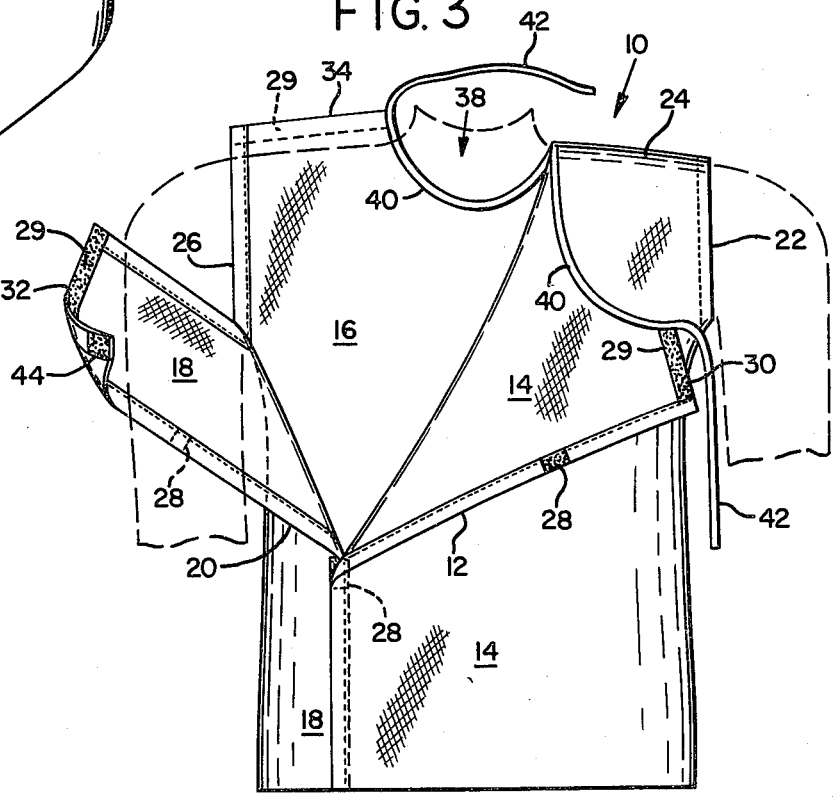
FIG. 3 is a front view of the gown of FIG. 1 but showing both portions of the front panel partially opened as in preparation for removal of the gown.

As best seen in FIG. 3, releasable fastening means 28 are provided along end edges 12 and 20 so that when overlapped, these edges are releasably fastened together. Releasable fastening means 29 are provided along the upper edges 30 and 32 of the front panels 14 and 18 and along the upper edge 34 of the back panel 16. As best seen in FIG. 1, the upper edges 30 and 32 are designed to overlap the upper edge 34 for releasably fastening the upper edges of the front panels 14 and 18 to the back panel 16 and thereby form the second shoulder portion 36.

An opening 38 between the shoulder portions 24 and 36 accomodates the neck of the patient and is trimmed with a collar 40 sewn into the upper edges of the front and back panels. Tie strings 42 extend from the collar at the back panel and the front panel where the front and back panel separate at shoulder portion 36 which when tied together as shown in FIG. 1 further secures the fastening together of the panels at shoulder portion 36.

Figure 2:
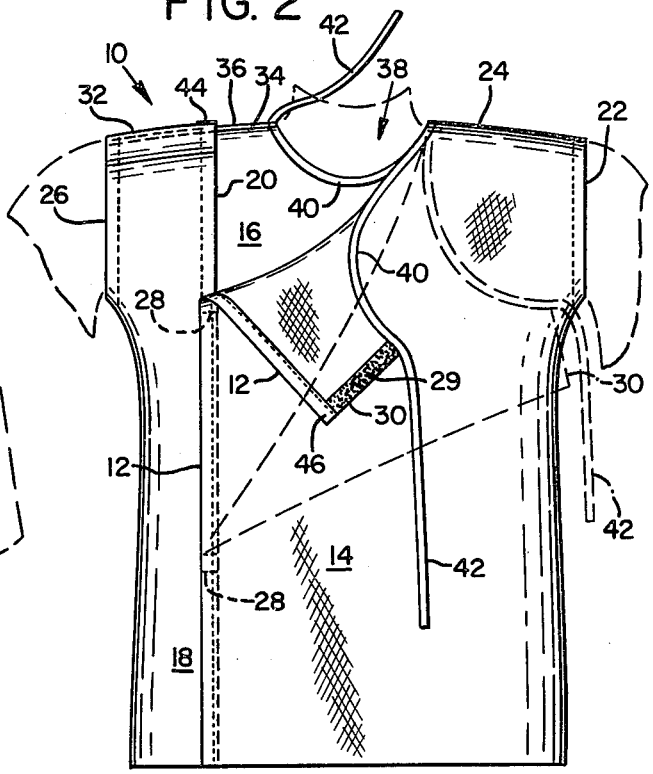
FIG. 2 is a front view of the gown of FIG. 1, but showing a portion of the front panel partially open as in preparation for examination.

Whereas a number of different types of fasteners are available for this improved hospital gown (snaps, clips, buttons, etc.) the preferred fastener is the interlocking fabric fastener sold under the Trademark VELCRO. With this type of fastener a section 44 of the fastening material can be provided at the top of edge 20 to be engaged by the fastening material along edge 30. As can be seen in FIG. 2, the edge 12 at it's juncture with edge 30 is free of the fastening material and forms a tab 46 that can be grasped and pulled to readily free front panel 14 from front panel 18 and back panel 16. It has been found that such fabric fasteners can be fastened and unfastened many times without affecting the holding power of the fastener. They also withstand washing over and over again as required for hospital gowns and they are acceptably comfortable to the patient.

How It Works

It will be understood that the gown 10 of this invention is initially in a full open position. Assuming that the patient has one arm free (the left arm as shown in the drawings) and the other arm encumbered, the free arm of the patient is thrust through arm hole 22 and the back and front panels of the gown are wrapped around the front and back of the patient. Front panel 18 is slipped under the encumbered arm of the patient and the end edges 12 and 20 are fastened together. With these end edges fastened together the upper edges 30 and 32 are overlapped and fastened to upper edge 34. This fully closed condition is illustrated in FIG. 1.

When a patient is to be examined, the doctor or attending nurse need only grasp the tab 46 and strip the panel 14 loose from the edge 34 of the back panel and the edge 20 of the front panel portion 18 as illustrated in FIG. 2. Complete removal of the gown is of course accomplished by further unfastening edge 32 from edge 34 and slipping the front panel 18 back under the patient's arm.

Variations and Alternate Embodiments

It will be appreciated that the reference to starting and end edges is used merely for purposes of explanation as is the selection of the patient's right side as the starting point for end edge 12. A modified gown can be provided with the end edges meeting at the left side of the patient as when for example, it is the patient's left arm that is encumbered by intraveneous feeding and the like. Still further, this gown can be made reversable so that simply turning it inside out places the end edges on the opposite side of the patient. Still further, in such a case where it is desirable to have the opening in the back, this gown readily accomodates that desire by simple putting it on backwards, i.e., it can be made reversable back to front as well as left to right.

Another possible variation in this gown is the provision of separable shoulder portions for both shoulders of the patient. That is, VELCRO strips can be provided at the upper edges of the juncture between the panels at shoulder portion 24 to accomodate the patient having both arms encumbered. And of course, as desired various tricks of the trade can be applied to make the gown both more attractive and more comfortable, e.g., providing pockets, sleeves, elastic waist bands and the like.

It is believed that those skilled in the art will conceive of numerous other variations, modifications and improvements once exposed to the concept of this invention. All are contemplated within this invention which is limited only by the definition provided by the following appended claims.

I claim:

1. A gown for hospital patients and the like comprising; a first front panel portion having a starting end edge adapted to be located at the front of one side of the patient and extending across the front of the patient to the other side, a back panel interconnected with the first front panel portion at said other side and adapted to extend across the back of the patient to said one side, and a second front panel portion interconnected with the back panel at said one side and extending to said starting end edge of the first panel portion and forming thereat an ending end edge; said back panel and first front panel portion having interconnected upper edge sections adjacent said other side to form a first shoulder portion, and said back panel having an upper edge section adapted to engage an upper edge section of each of the first and second front panel portions adjacent to starting and end edges thereof, and releasable fastening means for releasably fastening the end edges together and the upper edges of the front panel portions to the back panel to thereby form a second shoulder portion.

2. A gown for hospital patients and the like as defined in claim 1 wherein the releasable fastening means are fabric fasteners.

3. A gown for hospital patients and the like as defined in claim 1 wherein the beginning end edge overlaps the ending end edge and a tab is provided at the juncture between the beginning end edge and the upper edge of the first front panel portion to be grasped and pulled to draw back the first front panel portion and thereby expose the patient's chest and stomach areas for examination.

4. A gown for hospital patients and the like as defined in claim 1 with the back and front panel portion adapted to be selectively reversed left to right and back to front by location of the end edges in the back of the patient and by turning the gown inside out.

5. A gown for hospital patients and the like as defined in claim 1 wherein releasable fastening means provides the interconnection between the first front panel portion and the back panel forming the first shoulder portion.

6. A gown for hospital patients and the like as defined in claim 1 wherein tie straps are provided at the upper edges of the first panel portion and the back panel and adapted to tie said panels together as supplemental fastening means.

* * * * *